United States Patent [19]

Schwebel

[11] 3,931,964

[45] Jan. 13, 1976

[54] SHEET FEEDER APPARATUS

[75] Inventor: Adolf Schwebel, Offenbach am Main, Germany

[73] Assignee: Mabeg Maschinenbau GmbH, Offenbach, Germany

[22] Filed: Feb. 19, 1974

[21] Appl. No.: 443,820

[30] Foreign Application Priority Data

Feb. 23, 1973 Germany ..... 2309013

[52] U.S. Cl. ..... 271/93

[51] Int. Cl.[2] ..... B65H 3/40

[58] Field of Search ..... 271/93, 91, 98, 102, 103, 271/30 R

[56] References Cited

UNITED STATES PATENTS

| | | | |
|---|---|---|---|
| 1,442,718 | 1/1923 | Free | 271/91 |
| 3,071,371 | 1/1963 | Wickland | 271/103 X |
| 3,482,833 | 12/1969 | Schleiden | 271/98 |

*Primary Examiner*—Richard A. Schacher
*Attorney, Agent, or Firm*—W. G. Fasse; W. W. Roberts

[57] ABSTRACT

This sheet feeder apparatus employs sheet lifting suction heads which are raised by the pneumatic suction which simultaneously lifts a sheet from a stack. A spring, preferably inside each lifting suction head, lowers its telescoping suction nozzle in response to the movement of a cam and spring operated hold-up bar, which simultaneously synchronizes the downward movement of a pair of suction nozzles after delaying such downward movement long enough for the trailing edge of a sheet to clear the path of travel of the suction nozzle.

9 Claims, 2 Drawing Figures

SHEET FEEDER APPARATUS

BACKGROUND OF THE INVENTION

The present invention relates to a sheet feeder apparatus, more specifically to an apparatus wherein by means of suction heads sheets are lifted from a stack in order to be supplied to a machine, for example, a printing press or the like.

It is known to drive the suction heads vertically up and down by means of control cams secured to a drive shaft, whereby the cams operate levers and tension springs for controlling the vertical movement and thus the lifting of sheets from a stack. Simultaneously, such levers keep the suction nozzles in a raised position until the trailing edge of a sheet taken over by feed advance suction heads has cleared the range or path of travel of the lifting suction heads.

German Pat. No. 2,132,438 first published on Jan. 18, 1973, German patent publication no. 1,929,714 published on Oct. 8, 1970 and East German Pat. No. 9,237 published Feb. 17, 1955 disclose various prior art sheet lifting and feed devices. Thus, suction heads for sheet feeders are known in which the sheet separating suction heads are controlled mechanically by rotating cam means and pneumatically by the application of suction air to the separating nozzles of these suction heads, whereby such application of suction air is accomplished in a timed sequence. A pivotable control lever bears against the cam track of a cam by means of a cam follower roller for accomplishing the mechanical control. A tension bar is secured to the free end of said control lever either in a pivotable or in a guided fashion. The tension bar in turn supports the separating suction heads and their carrier means.

A tension spring secured to the control lever assures that the cam follower roller of the control lever remains in cooperating contact with the cam track at least during the operation of the apparatus. The type of arrangement poses difficulties because the separating suction heads and their carrier means constitute a substantial mass, the inertia of which counteracts the effect of the tension spring.

Due to the fact that a substantial inertia tends to eliminate the action of the tension spring, the latter is subjected to large loads, especially where high sheet transport speeds are involved. Accordingly, the tension spring means are subject to substantial wear and tear and must be exchanged frequently. The just described prior art devices are substantially described in the above first mentioned two German patent publications. Further, a time delay results from the spring inertia, especially of heavy duty springs used in mechanical lifters.

The East German Pat. No. 9,237 discloses an apparatus for holding-up the separating suction nozzles of the suction heads by controlled pawl-type lever means. One such pawl-type lever means is provided for each separating suction nozzle. Each pawl-lever requires a substantial number of suitable translating lever means with the respective pivot or journal means which are subject to substantial wear and tear. Further, the suction heads disclosed in said East German patent require similarly as in the first mentioned two West German patent publications, mechanical means for the up and down movement of their separating suction nozzles. Such mechanical means are necessary in addition to the pneumatic actuation of the nozzles.

The above described features of the prior art especially the fact that substantial masses are involved in the movement of the suction means pose a limitation on the working speed of prior art devices which is not compatible with presently required sheet feed advance speeds for example in a high speed printing press.

OBJECTS OF THE INVENTION

In view of the foregoing, it is the aim of the present invention to achieve the following objects singly or in combination:

to avoid mechanical means for the controlled up and down movement of the sheet separating suction means;

to employ the pneumatic control of the suction nozzles as the source for the control of the up and down movement;

to minimize the number of mechanical elements so as to reduce the mass of the moving parts of the apparatus;

to arrange the elements in such a manner that the working effect of the spring forces which cause the lowering of the suction nozzles will be aided by gravity; and to arrange the cam control means in such a manner that they will keep the suction nozzles in an upper end position for a predetermined length of time.

SUMMARY OF THE INVENTION

According to the invention there is provided a sheet feeder apparatus including suction head means secured to a frame structure. The suction head means include a normally stationary member and a nozzle member. Two members are arranged for telescoping relative to each other. The normally stationary member is supported by bearing means in the frame structure in such a manner that it is adjustable with its longitudinal axis relative to the vertical. The suction nozzle is movable between a sheet take-up lower position and a sheet delivery upper position. As soon as a pick-up sheet closes the nozzle, the inner space of the suction head means is evacuated sufficiently for the nozzle to jump into the upper position due to said evacuation and the external atmospheric pressure. Thus, the sheet is lifted into a transfer position in a single work stroke. A cross guide bar preferably extending horizontally is provided for holding a pair of nozzles in the upper delivery position. The cross guide bar is secured to the free end of a horizontally arranged pivotal lever, the opposite end of which is journaled on a horizontal axis. A tension spring urges a cam follower, such as a roller secured to the pivotal lever, against a cam member such as an excenter having a shape which determines the duration of time during which the nozzle stays in the upper end position.

BRIEF FIGURE DESCRIPTION

In order that the invention may be clearly understood, it will now be described, by way of example, with reference to the accompanying drawings, wherein:

FIG. 1 is a somewhat schematic side view illustration of the present apparatus, whereby parts not essential to the invention have been omitted; and FIG. 2 is a rear view of the apparatus according to FIG. 1 partially in section.

DETAILED DESCRIPTION OF EXAMPLE EMBODIMENTS

Figure 1:
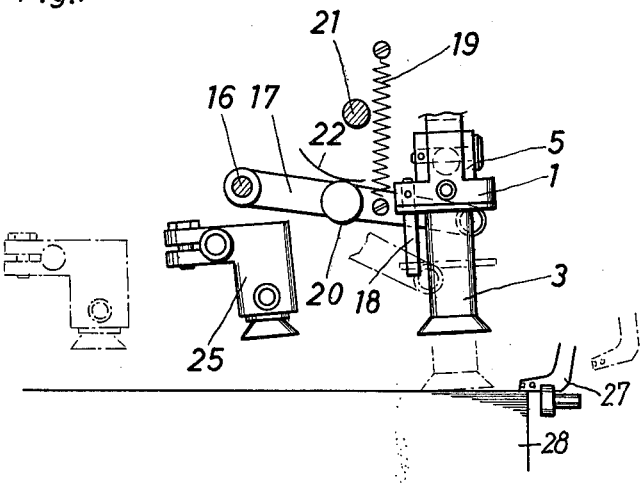

The sheet separating suction means 1 and 2 comprise telescoping members including an upper member and a lower nozzle member 3 and 4. The upper member of each suction head is secured to the side walls 7 or 8 respectively of a frame structure 9 by bearing means 5 and 6 respectively.

Figure 2:
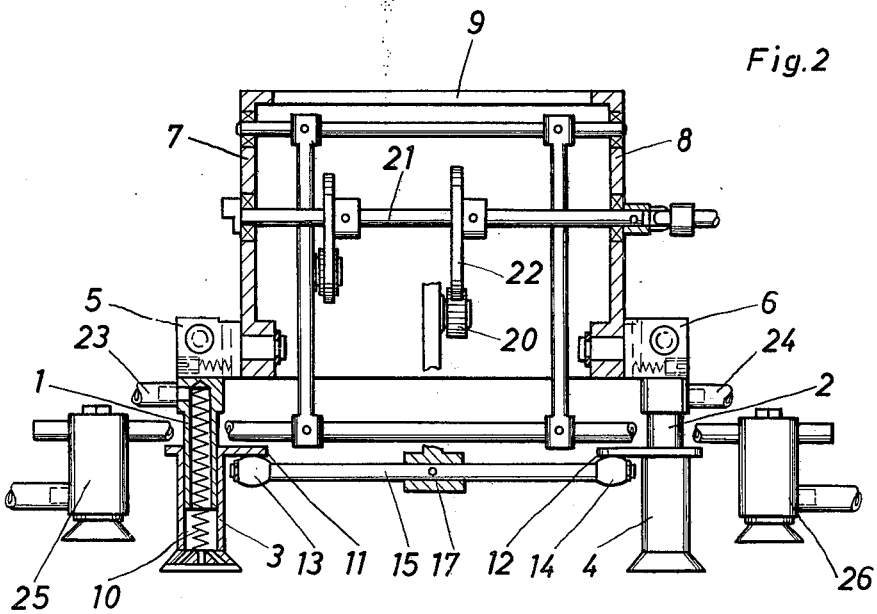

The suction nozzles 3, 4 are arranged for telescoping movement up and down along the respective upper suction head members as best seen in FIG. 2. FIG. 1 illustrates the upper sheet delivering position of the suction head in full lines and the lower sheet separating or sheet pick-up position in dashed-dotted lines. Conventional blow means 27 are provided to lift the trailing edge of the sheets in the stack 28 in timed relation with the raising and lowering of the suction nozzles. Such blow means 27 are well known in the art.

Each suction head 1 and 2 comprises a compression spring 10 located inside the hollow space of the suction head to normally urge the suction head members apart, whereby the nozzle members 3, 4 are moved against the surface or top sheet of the stack 28. According to the invention, the nozzles 3, 4 are provided with collars or flanges 11 and 12 providing respective guide surfaces. The collars 11, 12 rest on the ends of a guide cross bar 15. Freely rotatable rollers 13 and 14 are secured at the free ends of the guide bar 15. The cross bar 15 is supported intermediate its ends at the free end of a pivotable lever 17. The opposite end of the lever 17 is journaled to a horizontally extending axis 16. The telescoping movement of the suction nozzles 3, 4 is guided by a bar 18 extending substantially in parallel to the longitudinal axis of the suction head means and through a respective aperture in the flange 11, 12.

A tension spring 19 secured at one end thereof to the lever 17 and at the other end thereof to the frame structure 9 urges the lever 17 with its cam follower roller 20 against the cam track of a cam member 22 such as an excenter secured to a drive shaft 21, whereby the roller 20 preferably bears upwardly against the excenter 22.

Evacuation hose means 23, 24 are connected to the respective suction heads 1 and 2. These evacuation means are connected to an exhaust pump not shown. Further suction heads 25 and 26 are provided for the transfer of the sheets which are successively lifted by the lifting nozzles 3 and 4.

The cooperation of the above described elements is such that in operation the sheet separating nozzles 3 and 4 are supplied repeatedly with suction air through the hose means 23, 24, and preferably through control valves not shown. The suction air is supplied prior to the time when the suction nozzles 3, 4 reach the surface of the stack 28. Thus, the top sheet, the trailing edge of which has already been lifted by the blow means 27, is immediately picked up, thereby closing the apertures in the lower end of the suction head. As a result, the reduced pressure inside the suction head is sufficient to cause the atmospheric pressure to instantaneously raise the nozzle 3, 4 thereby loading the respective spring 10. Just as soon as the lifting nozzles 3, 4 reach their upper position, the transfer suction heads 25, 26 take over the sheet for horizontal movement as indicated in FIG. 1.

Due to the horizontal guide cross bar 15, the two suction nozzles 3, 4 will operate in synchronism, since, the bar in response to the action of the spring 19, will follow the upward movement of the suction heads 3, 4. This also depends on the shape and instantaneous position of the excenter 22. It has been found that the follow-up movement of the ends 13, 14 of the guide bar 15 does not interfere with the pick-up movement of the nozzles 3, 4.

The excenter 22 has such a shape that subsequent to the removal of the lifted sheet from the lower surface of the nozzles 3, 4 the suction heads are held in the upper end position for a duration sufficient to permit the trailing edge of the sheet to clear the path of travel of the suction nozzles 3, 4. As soon as the path is clear for the downward movement, the excenter has reached such a position in its course of rotation that the springs 10 may now push the nozzles 3, 4 downwardly into the pick up position. The compression spring 10 is preferably arranged inside the hollow telescoping suction head means. However, these springs could also be arranged on the outside. Preferably, the downwardly directed force on the nozzle head should be larger than the upwardly directed force of the spring 19 to positively move the suction nozzles 3, 4 into the pick-up position.

Although the invention has been described with reference to specific example embodiments, it will be appreciated, that it is intended to cover all modifications and equivalents within the scope of the appended claims.

What is claimed is:

1. A sheet feeder apparatus comprising a frame structure, hollow telescoping suction head means including a stationary support means secured to said frame structure and suction nozzle means movable relative to said support means, first spring means operatively arranged between said support means and nozzle means for normally relatively urging said support means and nozzle means apart, suction means connected to said head means for evacuating said head means while lifting a sheet, said movable nozzle means comprising a guide surface, said apparatus further comprising guide means pivotally mounted in said frame structure cam means arranged for actuating said guide means, and second spring means urging said guide means simultaneously into cooperating relationship with said cam means and with said guide surface of the nozzle means, whereby said first spring means urges said guide means away from said cam means, and wherein said suction head means comprises two suction heads, the support means of each head comprising a stationary member, the nozzle means of each head comprising a telescoping suction nozzle member, said guide surface comprising a collar guide surface on each said suction nozzle member, said guide means comprising a substantially horizontally arranged guide bar having free ends in contact with the collar guide surfaces of said suction nozzle members, pivotally mounted lever means, means securing said guide bar intermediate its free end to said pivotally mounted lever means, cam follower means secured to said lever means for cooperating with said cam means, and means for securing said second spring means between said frame structure and said lever means.

2. The apparatus according to claim 1, further comprising a horizontal axis, said pivotally mounted lever means being journaled at one of its ends to said horizontal axis, and means securing said guide bar to the opposite end of said pivotally mounted lever means.

3. The apparatus according to claim 2, wherein said cam means are arranged above said pivotally mounted lever means whereby said second spring means urge said cam follower means upwardly against said cam means, and wherein each of said guide surfaces is arranged above its respective free end of said guide bar whereby the second spring means simultaneously urge the free ends of the guide bar upwardly against the respective guide surface.

4. The apparatus according to claim 3, wherein said free ends of the guide bar comprise roller means rotatably secured to said free ends.

5. The apparatus according to claim 1, wherein said first spring means comprise compression spring means arranged inside said hollow telescoping suction head means.

6. The apparatus according to claim 1, wherein said first spring means exert a downwardly directed force on said nozzle means and wherein said second spring means exert an upwardly directed force on said guide surface, said downwardly directed force being larger than said upwardly directed force.

7. The apparatus according to claim 1, wherein said cam means comprise an excenter cam having such a shape that said nozzle means is held in an upper position until the trailing edge of a sheet has left the travel range of said nozzle means.

8. The apparatus according to claim 1, further comprising a bar secured to said support means, collar means on said nozzle means forming said guide surface, and an aperture in said collar means, said bar extending slidably through said aperture.

9. The apparatus according to claim 1, wherein said first spring means exerts a force urging said support means and nozzle means apart, that is greater than the force of said second spring means opposing the force of said first spring means.

* * * * *